US005878619A

United States Patent [19]

Walczak

[11] Patent Number: 5,878,619

[45] Date of Patent: Mar. 9, 1999

[54] LAMINATED PUNCH AND DIE ASSEMBLIES

[76] Inventor: Kenneth H. Walczak, 64 York Rd., Niagara Falls, N.Y. 14304

[21] Appl. No.: 20,399

[22] Filed: Feb. 9, 1998

[51] Int. Cl.[6] ..... B21D 5/02; B21D 37/02

[52] U.S. Cl. ..... 72/478; 72/381; 72/389.3; 72/413

[58] Field of Search ..... 72/381, 389.3, 72/413, 478

[56] References Cited

U.S. PATENT DOCUMENTS

| | | | |
|---|---|---|---|
| 271,178 | 1/1883 | Wieser | 72/478 |
| 3,323,348 | 6/1967 | Pearson | 72/413 |
| 3,474,657 | 10/1969 | Spiegel | 72/478 |

FOREIGN PATENT DOCUMENTS

| | | | |
|---|---|---|---|
| 2-229621 | 9/1990 | Japan | 72/478 |

*Primary Examiner*—David Jones
*Attorney, Agent, or Firm*—Phillips, Lytle, Hitchcock, Blaine & Huber LLP

[57] ABSTRACT

A laminated punch assembly (20) is adapted for use in a press brake to bend sheet metal (M) interposed between a punch and die when the punch and die are moved relatively toward one another. The improved punch assembly includes a plurality of plate-like members (24). Each member has large-area obverse and reverse faces (30, 31), and has a peripheral surface. A slot extends into each member from a portion of its peripheral surface, and communicates the two faces. The plurality of members are arranged in face-to-face area contact to define an elongated laminated punch assembly, with the slots of each member being aligned to form an elongated slot in the punch assembly. An elongated insert (26) is adapted to be slidably inserted into the punch assembly slot, and has an exposed bending surface (63) adapted to engage the sheet material when the brake is used.

The invention also provides an improved die assembly for use in such a press brake. The improved die assembly similarly includes a plurality of plate-like members (28), with each member having large-area obverse and reverse faces (65, 66) and having a peripheral surface. A slot extends into each member from a portion of the peripheral surface, and communicates the two faces. A plurality of the members are arranged in face-to-face area contact to define an elongated laminated die assembly, with the slots of each member being aligned to form an elongated slot in the die assembly. An elongated insert (29) is adapted to be slidably inserted into the die assembly slot. The insert has a die surface adapted to engage the sheet material when the brake is used.

15 Claims, 2 Drawing Sheets

LAMINATED PUNCH AND DIE ASSEMBLIES

TECHNICAL FIELD

The present invention relates generally to punches and dies for use in press brakes and punch brakes, and, more particularly, to improved laminated punch and die assemblies that may be selectively assembled and disassembled for different jobs.

BACKGROUND ART

Press brakes and box brakes are used in metal forming and shaping. A press brake is a relatively large machine having an upper platen that is arranged to be moved upwardly and downwardly relative to a lower platen. A punch is normally held to the movable upper platen, and a die is normally held on the lower platen. Hence, when the upper platen moves relative to the lower platen, the punch moves upwardly and downwardly relative to the die. These cooperative punch and die sets are used for a variety of metal forming operations, such as bending, punching, providing detents and recesses, and the like.

A box brake is functionally similar to a press brake. However, the box brake is typically hand operated, whereas the press brake is normally powered hydraulically. Thus, for all intents and purposes, the only functional difference between a box brake and a press brake is the physical size of the brake and the motive power to move the punch relative to the die in metal shaping operations.

In either case, a business must normally stock in inventory a large number of punches and dies, since these are largely tailored to the particular part being formed. Such tooling is expensive to manufacture, and can be difficult to store and maintain. In some cases, a piece of tooling will be cannibalized for use in subsequent similar operations. To the extent that the tool that the punch or die has been modified, it is no longer available to do its original function. This further complicates the problem of storing punches and dies for use in such operations.

Accordingly, it would be generally desirable to provide improved punches and dies that can be selectively assembled to do a particular job, and then broken down into individual component parts for subsequent reassembly for a sequential job.

DISCLOSURE OF THE INVENTION

With parenthetical reference to the corresponding parts, portions or surfaces of the disclosed embodiment, merely for purposes of illustration and not by way of limitation, the present invention broadly provides, in one aspect, an improved punch assembly (20) for use in a brake, such as a press brake or a box brake, that is adapted to bend sheet material (M) interposed between a punch and die when the punch and die are moved relatively toward one another. The improved punch assembly broadly includes a plurality of plate-like members (24) and an elongated insert (26). Each plate-like member has a large-area obverse and reverse faces (30, 31), and has an outer peripheral surface. Each member has a slot extending into the member from a portion of the peripheral surface and extending between the two faces. The plurality of members are arranged in face-to-face area contact to define an elongated laminated punch assembly, with the slots of each member being aligned so as to form an elongated slot in the punch assembly. The insert (26) is adapted to be releasably held in the punch assembly slot, and has a bending surface (61, 62, 63 or 64) adapted to engage the sheet material when the brake is used.

In the preferred embodiment, each member has at least one recess (55) extending into the member from one face thereof and has at least one detent (58)extending outwardly from the other face thereof, with the detent of one member being adapted to be inserted into the recess of the adjacent member for facilitating the positioning of the members when the punch assembly is formed. Each member slot may be in form of a corner recess having two surfaces, with a lug portion (53, 54) extending outwardly from each slot surface.

The insert (26) may be a solid member having a substantially rectangular end elevation, with recesses (60) extending into the insert from at least two longitudinally-extending side surfaces thereof to receive the member lug portions (53, 54). The bending surface is normally arranged between adjacent insert side surfaces. In the preferred embodiment, a bending surface is arranged between each of the adjacent side surfaces, such that the insert may be slidably inserted into the punch assembly slot at 90° intervals, with the radius of each bending surface being different from one another. This allows the punch designer to simplify the inventory of parts necessary to perform a given operation. However, the insert may be otherwise secured to the plates, as by some type of mechanical interlock or be welding it in place.

The insert need not necessary extend the entire length of the punch assembly slot, as when it is desired to deliberately form a "window" or an interruption in the bending operation.

The improved punch assembly may further include means for holding the punch assembly members together. In one form, these members may simply be clamped together, as in a vice, and the assembly thereafter removed and suitably clamped in the jaws of the brake. In another embodiment, the various members may be provided with holes which are adapted to align with one another when the punch assembly is formed to accommodate passage of the shank portion of an elongated fastener (59) by which the punch assembly may be retained as an integral monolithic unit.

In another aspect, the invention also provides an improved die assembly (21) for use in a brake adapted to bend sheet material interposed between a punch and die when the punch and die are moved relatively toward one another. The improved die assembly broadly includes a plurality of plate-like members (28), and an elongated insert (29). Each member has a large-area obverse and reverse faces (65, 66, and has an outer peripheral surface. Each member has a slot extending into the member from a portion of the outer peripheral surface, and extends between the two faces. A plurality of these members are arranged in face-to-face area contact to define an elongated laminated die assembly, with the slots of each member being aligned to for an elongated slot in the die assembly. The insert (29) is adapted to be releasably held within the die assembly slot, and has a die surface (92) adapted to engage the sheet material when the brake is used.

In the preferred embodiment, each plate-like member has at least one recess (90) extending into the member from one face thereof and at least one detent (91) extending outwardly from the other face thereof, with a detent of one plate being adapted to be inserted into the recess of an adjacent plate for facilitating the positioning of the members when the die assembly is formed. Each plate slot may be in the form of a corner recess having two surfaces, with a lug portion extending outwardly from each slot surface. The insert need not necessary extend the entire length of the slot. In the preferred form, the insert is adapted to be slidably inserted into the die assembly slot.

As with the punch assembly, the improved die assembly may incorporate means for holding the laminated die assembly together. This means may include a plurality of holes provided through the various plate-like members to accommodate passage of an elongated fastener (109) by which the various plate-like members may be compressively sandwiched together.

Accordingly, the general object of the invention is to provide an improved punch assembly for use in a press brake, a box brake, or the like.

Another object is to provide an improved die assembly for use in a press brake, box brake, or the like.

Still another object to provide improved punches and dies that are built-up by assembling a plurality of plate-like members, with an insert being operatively slid into an assembly slot, such that the punches or dies may be readily assembled and disassembled as needed.

These and other objects and advantages will become apparent from the foregoing and ongoing written specification, the drawings, and the appended claims.

DESCRIPTION OF THE PREFERRED EMBODIMENT

Figure 1:
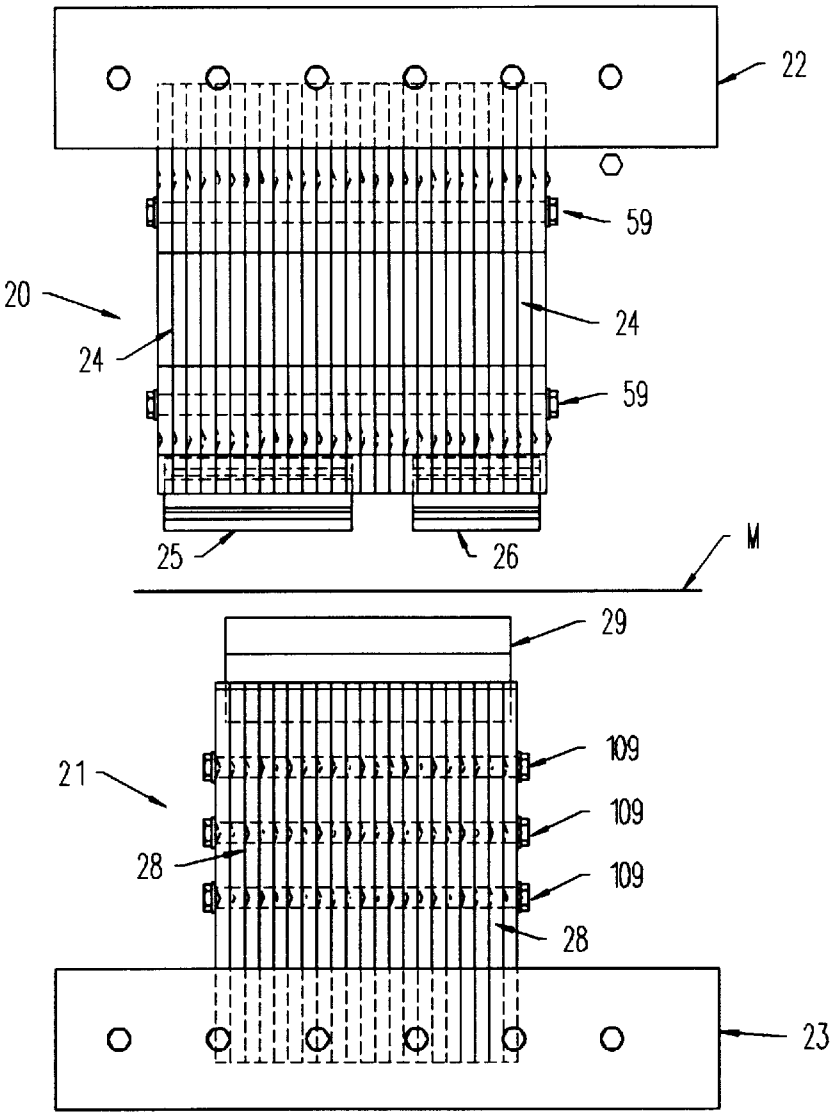
FIG. 1 is a fragmentary schematic side elevational view of a press brake showing the improved punch and die therein.

At the outset, it should be clearly understood that like reference numerals are intended to identify the same structural elements, portions, or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up", and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis or elongation, or axis of rotation, as appropriate.

Referring now to the drawings, and, more particularly, FIG. 1 thereof, the present invention provides an improved punch assembly and an improved die assembly for use in a brake, such as a press brake or box brake. In FIG. 1, the punch assembly is generally indicated at 20, the die is generally indicated at 21, and the jaws of the upper and lower platens of a press brake, are fragmentarily illustrated at 22, 23, respectively. In the wellknown manner, the upper platen of the press brake is adapted to be moved vertically upwardly and downwardly relative to the lower platen to move the punch assembly relative to the die assembly. This is used in a variety of metal forming and shaping operations, such as bending, punching, scoring, and the like.

The improved punch assembly 20 is shown as including a plurality of plate-like members, severally indicated at 24, having their upper marginal end portions operatively clamped between the jaws 22 of the upper platen, and carrying one or more inserts, indicated at 25, 26, for cooperative use with the die. Similarly, die assembly 21 is shown as having a plurality of plate-like members, severally indicated at 28, having their lower marginal end portions arranged to be clamped between the opposed jaws 23, 23 of the lower platen, and as having an insert 29 held in operative facing relation to the inserts 25, 26 of the punch.

Figure 3:
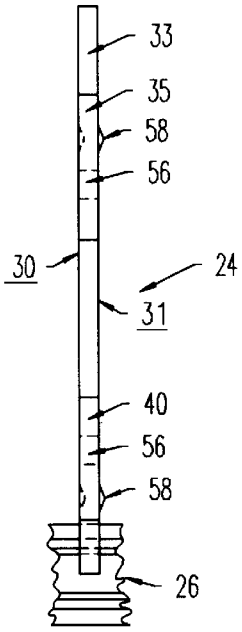
FIG. 3 is a side elevation of the plate-like member and insert shown in FIG. 2.
Figure 2:
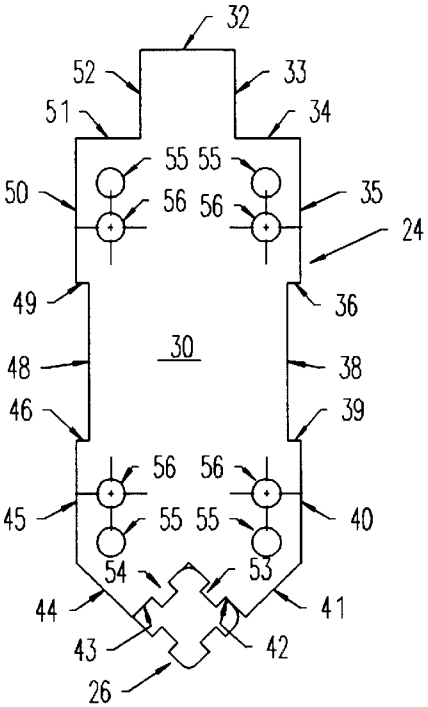
FIG. 2 is a front elevational view of one of the plate-like members used in forming the laminated punch, with the insert operatively arranged in the punch assembly slot.

Referring now to FIGS. 2 and 3, each punch member 24 is shown as being a plate-like member having a large-area obverse and reverse faces 30, 31, respectively. Member 24 also has an outer peripheral surface which sequentially includes: an upwardly-facing horizontal surface 32, a rightwardly-facing vertical surface 33, an upwardly-facing horizontal surface 34, a rightwardly-facing vertical surface 35, a downwardly-facing horizontal surface 36, a rightwardly-facing vertical surface 38, an upwardly-facing horizontal surface 39, a rightwardly-facing vertical surface 40, a rightwardly- and downwardly-facing planar surface 41, a downwardly- and leftwardly-facing planar surface 42, a downwardly- and rightwardly-facing planar surface 43, a downwardly- and leftwardly-facing planar surface 44, a leftwardly-facing vertical surface 45, an upwardly-facing horizontal surface 46, a leftwardly-facing vertical surface 48, a downwardly-facing horizontal surface 49, a leftwardly-facing vertical surface 50, an upwardly-facing horizontal surface 51, and a leftwardly-facing vertical surface 52 continuing upwardly therefrom to join the left marginal end portion of upper most surface 32. Integrally-formed rectangular lugs 53, 54 extend normally outwardly from surfaces 42, 43, respectively, for a purpose hereinafter apparent.

When member 24 is formed, four holes, severally indicated at 55 are provided through member 24 so as to communicate surfaces 30 and 31. In addition to this, four detents and recesses are formed in member 24. These detents-and-recesses are typically formed by a punching operation which forms a recess 56 in the member from surface 30, and which forms a detent 58 extending from the other face, as shown in FIG. 3. These detents-and-recesses are useful in positioning the plate-like members relative to one another when the punch assembly is formed. Holes 55 are provided to accommodate the passage of the shank portion of elongated fasteners, such as indicated at 59 in FIG. 1. These fasteners may be used to compressively hold the laminated plate assembly together to form the assembled punch.

Each plate-like member has a comer slot formed at its lower end, which is defined by surfaces 42, 43. Lug members 53, 54 extend normally (i.e., perpendicularly, from surfaces 42, 43) to cooperate with the insert.

Figure 4:
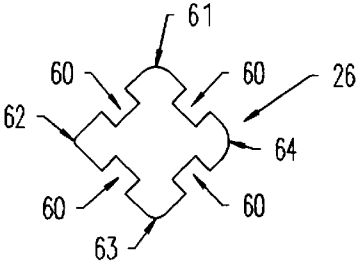
FIG. 4 is an enlarged front elevational view of the insert shown in FIG. 2.

Referring now to FIG. 4, the insert is shown as being a horizontally-elongated solid member having a substantially rectangular end elevation. A rectangular recess, severally indicated at 60, extends into the member from each of the four sides, thereof, to receive and accommodate plate member lug portions 53, 54. The four corners of the insert are severally rounded, as indicated at 61, 62, 63 and 64, but are of different radii. Thus, the operator may simply orient the insert to the angular position such that the desired radius will be at the six o'clock position of the insert, and then slidably inserted into the punch assembly slot. To change the bending radius, the operator need only to slidably withdraw the insert from the slot, rotate it to a new angular position at which a desired radius will be in the six o'clock position, and then reinsert the insert into the punch assembly slot. The insert need not extend the entire length of the punch assembly, as indicated by the "window" or space between inserts 25 and 26 in FIG. 1.

Figure 6:
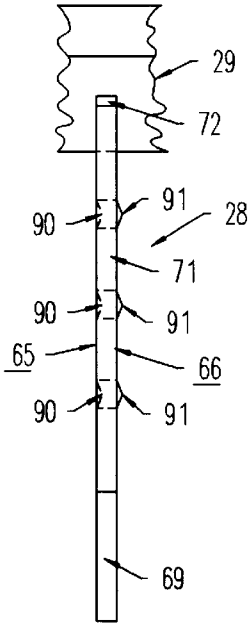
FIG. 6 is a side elevation of the plate-like member and insert shown in FIG. 5.
Figure 5:
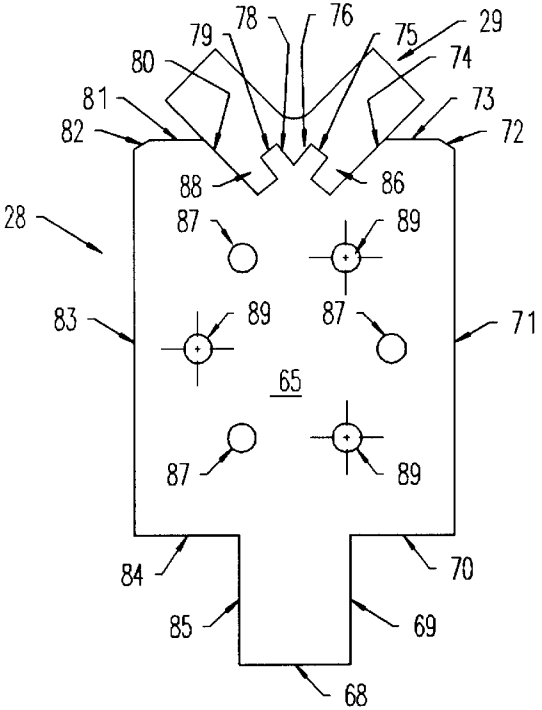
FIG. 5 is a front elevational view of a plate-like member used in forming the improved die, showing a die insert therein.
Figure 7:
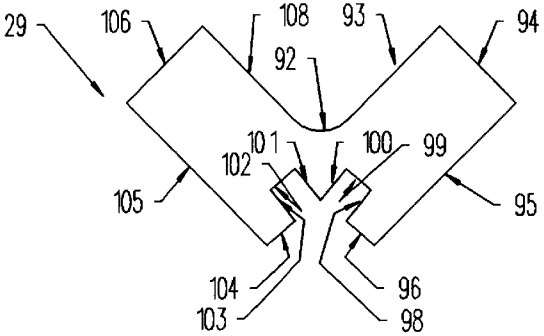
FIG. 7 is an enlarged front elevational view of the die insert shown in FIG. 5.

Referring now to FIGS. 5–7, the die assembly plate-like members 28 are shown as being specially-configured plate-like members having large-area obverse and reverse faces 65, 66, respectively. The die member has an outer peripheral surface which sequentially includes: a lowermost downwardly-facing horizontal surface 68, a rightwardly-facing vertical surface 69, a downwardly-facing horizontal surface 70, a rightwardly-facing vertical surface 71, a chamfered corner 72, an upwardly-facing horizontal surface 73, an upwardly-and leftwardly-facing planar 74, an upwardly-and rightwardly-facing planar surface 75, an upwardly- and leftwardly-facing planar surface 76, a upwardly- and rightwardly-facing planar surface 78, an upwardly- and leftwardly-facing planar surface 79, an upwardly- and rightwardly-facing planar surface 80, an upwardly-facing horizontal surface 81, a chamfered surface 82, a leftwardly-facing vertical surface 83, a downwardly-facing horizontal surface 84, and a leftwardly-facing vertical surface 85 continuing downwardly therefrom to join the left margin of lower most surface 68. Rectangular slots 86, 88 extend into the plate-like member from surfaces 75 and 79, respectively.

Plate-like member 28 is shown as being further provided with a plurality of holes, severally indicated at 89, and with detents-and-recesses. As best shown in FIG. 6, the recesses are indicated at 90, and the detents are indicated at 91. These are formed by a partial punching operation that does not extend completely through the plate-like member. Here again, these detents-and-recesses are deemed particularly useful in assembling the plate-like members to form the punch assembly.

As best shown in FIG. 7, the die insert 29 is a horizontally-elongated solid member having a specially-configured end elevation. More particularly, this die is shown as sequentially including: a central upwardly-facing concave die surface 92 adapted to engage the sheet material being bent, an upwardly- and leftwardly-facing planar surface 93, an upwardly- and rightwardly-facing planar surface 94, a downwardly- and rightwardly-facing planar surface 95, a downwardly- and leftwardly-facing planar surface 96, an upwardly- and leftwardly-facing planar surface 98, a downwardly- and leftwardly-facing planar surface 99, a downwardly- and rightwardly-facing planar surface 100, a downwardly- and leftwardly5 facing surface 101, a downwardly- and rightwardly-facing planar surface 102, an upwardlyand rightwardly-facing planar surface 103, a downwardly- and rightwardly-facing planar surface 104, a downwardly- and leftwardly-facing planar surface 105, an upwardly- and leftwardly-facing planar surface 106, and an upwardly- and rightwardly-facing planar surface 108 continuing downwardly therefrom to join the left marginal end portion of concave die surface 92. The die insert is adapted to be slidably inserted into the elongated slot formed by assembling the plate-like members together. Here again, the insert may be continuous over the length of the die assembly, or may be interrupted as in the case of the punch. The plate-like members are further provided with a plurality of holes severally indicated at 87 to receive and accommodate fasteners, such as indicated at 109 in FIG. 1, but which the die assembly may be held together.

Therefore, the invention provides an improved punch assembly, such as indicated at 20, and an improved die assembly, such as indicated at 21. The improved punch and die assemblies broadly include a plurality of plate-like members which are operatively arranged in face-to-face relation to form the punch and die assemblies. Inserts are adapted to be longitudinally inserted into the slots formed in these assemblies. Those, the invention provides an improved way but which a punch and die may be assembled, and subsequential disassembled for subsequent use and reconfiguration in other operations.

Modifications

The present invention contemplates that many changes and modifications may be made. For example, the shape of the plate-like members is exemplary only, and may be readily changed as desired. Similarly, the shape and configuration of the inserts may be readily changed depending on the type of metal forming operation desired. Multiple inserts may be used in any punch assembly or any die assembly depending on the intended operation. The insert may be slidably inserted into the assembled slot, or may be otherwise attached to the assembled plates. These other techniques include mechanical interconnections and welding, as desired.

The invention also contemplates that other tools may be mounted on the punch assembly or the die assembly. These tools may include punches, scoring bars, and the like. The materials of construction are not deemed critical, the shape and configuration of the individual parts may be readily changed as desired.

Therefore, while the presently-preferred form of the improved punch and die assemblies have been shown and described, and several modifications and changes thereof discussed, persons skilled in this art will readily appreciate that various additional changes and modifications may be made without departing from the spirit of the invention, as defined and differentiated by the following claims:

What is claimed is:

1. A punch assembly for use in a brake adapted to bend sheet material interposed between a punch and die when said punch and die are moved relatively toward one another, comprising:

a plurality of plate-like members, each member having large-area obverse and reverse faces and having a peripheral surface, each member having a slot extending into said member from said peripheral surface and extending between said faces, said plurality of members being arranged in face-to-face area contact to define an elongated laminated punch assembly with the slots of each member being aligned to form an elongated slot in said punch assembly; and an elongated insert releasably held in said punch assembly slot, said insert having a bending surface adapted to engage said material when said brake is used.

2. A punch assembly as set forth in claim 1, wherein each member has at least one recess extending into said member from one face thereof and at least one detent extending outwardly from the other face thereof, the detent of one member being adapted to be inserted into the recess of the adjacent member for facilitating the positioning of said members when said punch assembly is formed.

3. A punch assembly as set forth in claim 1 wherein each member slot is in the form of a corner recess having two surfaces, with a lug portion extending outwardly from each slot surface.

4. A punch assembly as set forth in claim 3 wherein said insert is a solid member having a substantially rectangular transverse cross-section, and wherein recesses extend into said insert from at least two longitudinally-extending side surfaces thereof to receive said member lug portions.

5. A punch assembly as set forth in claim 4 wherein said insert bending surface is arranged between adjacent side surfaces.

6. A punch assembly as set forth in claim 1 wherein said a bending surface is arranged between each adjacent insert side surface.

7. A punch assembly as set forth in claim 1 wherein said insert does not extend the entire length of said punch assembly slot.

8. A punch assembly as set forth in claim 1 and further comprising means for holding said laminated punch assembly together.

9. A punch assembly as set forth in claim 1 wherein said insert is arranged to be slidably inserted into said punch assembly slot.

10. A die assembly for use in a brake adapted to bend sheet material interposed between a punch and die when said punch and die are moved relatively toward one another, comprising:

a plurality of plate-like members, each member having large-area obverse and reverse faces and having a peripheral surface, each member having a slot extending into said member from said peripheral surface and extending between said faces, said plurality of members being arranged in face-to-face area contact to define an elongated laminated die assembly with the slots of each member being aligned to form an elongated slot in said die assembly; and an elongated insert releasably held in said die assembly slot, said insert having a die surface adapted to engage said material when said brake is used.

11. A die assembly as set forth in claim 10, wherein each member has at least one recess extending into said member from one face thereof and at least one detent extending outwardly from the other face thereof, the detent of one member being adapted to be inserted into the recess of the adjacent place for facilitating the positioning of said members when said die assembly is formed.

12. A die assembly as set forth in claim 10 wherein each member slot is in the form of a corner recess having two surfaces, with a lug portion extending outwardly from each slot surface.

13. A die assembly as set forth in claim 10 wherein said insert does not extend the entire length of said die assembly slot.

14. A die assembly as set forth in claim 10 and further comprising means for holding said laminated die assembly together.

15. A die assembly as set forth in claim 10 wherein said insert is adapted to be slidably inserted into said die assembly slot.

* * * * *